United States Patent [19]

Lemburg et al.

[11] 4,153,081

[45] * May 8, 1979

[54] APPARATUS FOR SEVERING AND DEFORMING THE ENDS OF HELICAL BINDERS FOR PADS OR THE LIKE

[75] Inventors: Jörn-Uwe Lemburg; Dieter Stolley, both of Hamburg, Fed. Rep. of Germany

[73] Assignee: E.C.H. Will (GmbH & Co.), Hamburg, Fed. Rep. of Germany

[ * ] Notice: The portion of the term of this patent subsequent to Jun. 20, 1995, has been disclaimed.

[21] Appl. No.: 898,336

[22] Filed: Apr. 20, 1978

Related U.S. Application Data

[63] Continuation of Ser. No. 821,177, Aug. 2, 1977, Pat. No. 4,095,623.

[30] Foreign Application Priority Data

Jan. 29, 1977 [DE] Fed. Rep. of Germany ..... 2703718

[51] Int. Cl.[2] ..... B21F 35/02

[52] U.S. Cl. ..... 140/92.7; 140/92.94

[58] Field of Search ..... 140/92.7, 92.94

[56] References Cited

U.S. PATENT DOCUMENTS

| | | | |
|---|---|---|---|
| 2,649,120 | 8/1953 | November | 140/92.7 |
| 3,508,729 | 3/1971 | Freundlich | 140/92.7 |
| 4,095,623 | 6/1978 | Lemburg et al. | 140/92.7 |

*Primary Examiner*—Lowell A. Larson
*Attorney, Agent, or Firm*—Peter K. Kontler

[57] ABSTRACT

Apparatus for looping the free end portions of the outermost convolutions of helical binders which are threaded through the perforations of a stack of loose leaves has a pivotable tool with a cutting edge which clips the end convolution of a properly located binder and a bending edge which bends the free end portion of the clipped end convolution over the neighboring convolution. A rotary loop forming device is thereupon actuated by a lever to convert the deformed end portion into a loop which surrounds the neighboring convolution. The loop forming device has a guide face which cooperates with a parallel second guide face provided on a reciprocable hold-down device which is caused to extend between the end convolution and the neighboring convolution while the end portion is converted into a loop. These guide faces cooperate with a guide face of a locating projection for the binder and with a guide face of the tool to define a channel which confines the end portion during loop forming so that the loop is located in a plane which includes the axis of the binder. The hold-down device has a notch which receives and prevents deformation of the remaining part of the outermost convolution while the free end portion is being looped around the neighboring convolution.

18 Claims, 9 Drawing Figures

1
2
3
4
5
6
7
8
9
10
11
12
13
14
17
18
19
21
23
26
27
28
29
36
37
42
43
44
47
51
52
53
54
56
58
59
62
63
67
68
71
72
73

APPARATUS FOR SEVERING AND DEFORMING THE ENDS OF HELICAL BINDERS FOR PADS OR THE LIKE

This is a continuation of application Ser. No. 821,177, filed Aug. 2,1977 now U.S. Pat. No. 4,095,623.

BACKGROUND OF THE INVENTION

The present invention relates to apparatus for severing or clipping and deforming the end convolutions or outermost convolutions of helical binders for stacks of loose leaves. More particularly, the invention relates to improvements in apparatus of the type wherein portions of both end convolutions of a helical binder are converted into loops or analogous configurations which surround the next-to-the-outermost convolutions, i.e., the convolutions which are adjacent (neighboring) to the end convolutions.

U.S. Pat. No. 3,568,729 to Freundlich et al. discloses an apparatus which converts portions of end convolutions of a helical binder into loops surrounding the neighboring (next-to-the-outermost) convolutions. The purpose of such loops is to prevent extraction of the binder from the openings or perforations of the leaves, to prevent interlacing of neighboring binders, and to reduce the likelihood of injury to the user of the pad. A drawback of the patented apparatus is its complexity and high initial and maintenance cost. Furthermore, the patented apparatus is prone to malfunction so that its operation must be monitored by attendants in order to reduce the number of rejects. In fact, special hand-operated machines have been designed to treat and repair the rejects of the patented apparatus, i.e., to put the rejects into a state in which they can be sold to customers.

One of several reasons for complexity and unreliability of the patented apparatus is that its wire severing and loop forming instrumentalities have been designed and assembled without taking into consideration the curvature of those portions of the end convolutions of the helical binder which are to be converted into loops. It has been found that, during the formation of loops, those portions of end convolutions which are about to be deformed tend to become entangled with other portions of the binder or shut against such other portions to thus prevent the formation of satisfactory loops.

Other references of which applicants were aware at the time of filing of the present application and which belong to the art of making and inserting helical binders for pads, note books or the like include U.S. Pat. Nos. 1,942,026, 1,985,776, 2,051,477, 2,058,272, 2,142,817, 2,161,689, 2,961,012, 2,995,157, 3,133,562, 3,134,406, 3,251,385, 3,404,711, 3,467,150, 3,520,334, 3,526,415, 3,568,729, 3,818,954, 3,826,290 and 3,972,109.

OBJECTS AND SUMMARY OF THE INVENTION

An object of the invention is to provide an apparatus which can deform the end convolutions of a helical binder with a heretofore unmatched degree of predictability, which turns out a negligible number of rejects, which can process a larger number of binders per unit of time than conventional apparatus, and which is not only simpler but also more compact and less expensive than presently known apparatus.

Another object of the invention is to provide the apparatus with novel and improved means for holding or locating helical binders in the course of deformation of portions of their end convolutions and with novel and improved binder severing or clipping and deforming or looping means.

The invention is embodied in an apparatus for severing or clipping at least one end convolution or outermost convolution of a helical binder which is threaded through the registering openings of a stack of loose leaves or the like. The apparatus comprises a locating device having means (e.g., recesses or slots) for holding the end convolution of a binder in a predetermined position, a severing tool (e.g., a lever having a cutting edge and a bending edge), a camor other suitable means for operating the tool so as to clip the end convolution of a binder which occupies the predetermined position and to thereupon bend the free end portion of the clipped end convolution over the neighboring (next-to-the-outermost) convolution, a preferably reciprocable hold-down device, a cam-operated lever or other suitable means for moving the hold-down device between the end convolution and the neighboring convolution of he binder occupying the predetermined position, a preferably rotary loop forming device, and means for actuating the loop forming device so as to convert the bent end portion of the end convolution into a loop which surrounds the neighboring convolution. The hold-down device has a first guide face which is substantially parallel to the axis of the binder and at least one of the other two (locating and loop forming) devices has a second guide face which is parallel to the first guide face and defines therewith a channel confining the end portion during conversion into the loop so that the latter is located in a plane which includes the axis of the binder.

The bending edge of the tool is preferably arranged to bend the free end portion of the end convolution into substantial parallelism with the axis of the binder. The loop forming device preferably includes an eccentric portion (e.g., an edge) which extends from the guide face of the loop forming device and converts the free end portion into a loop in response to rotation of the loop forming device.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

The apparatus which embodies the present invention preferably forms part of a production line for the manufacture of pads, note books and similar products wherein loose leaves of a stack 9 (normally including a front and/or a rear cover) are formed with registering openings or perforations for the convolutions of a helical binder 8 made of metallic wire or the like. The mobile parts of the apparatus receive motion from the main prime mover of the production line.

Figure 1:
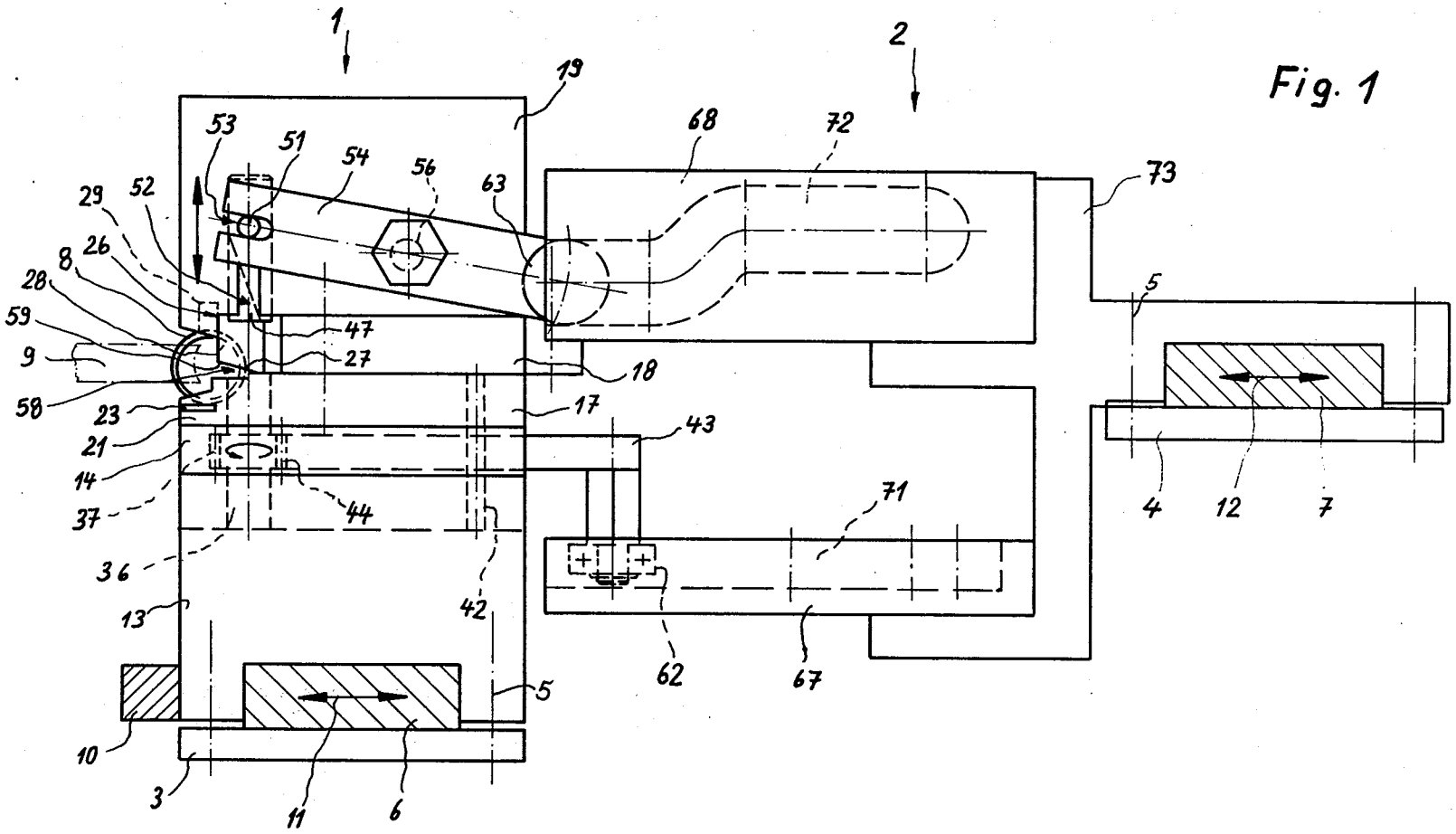
FIG. 1 is a fragmentary elevational view of an apparatus which embodies the invention.
Figure 2:
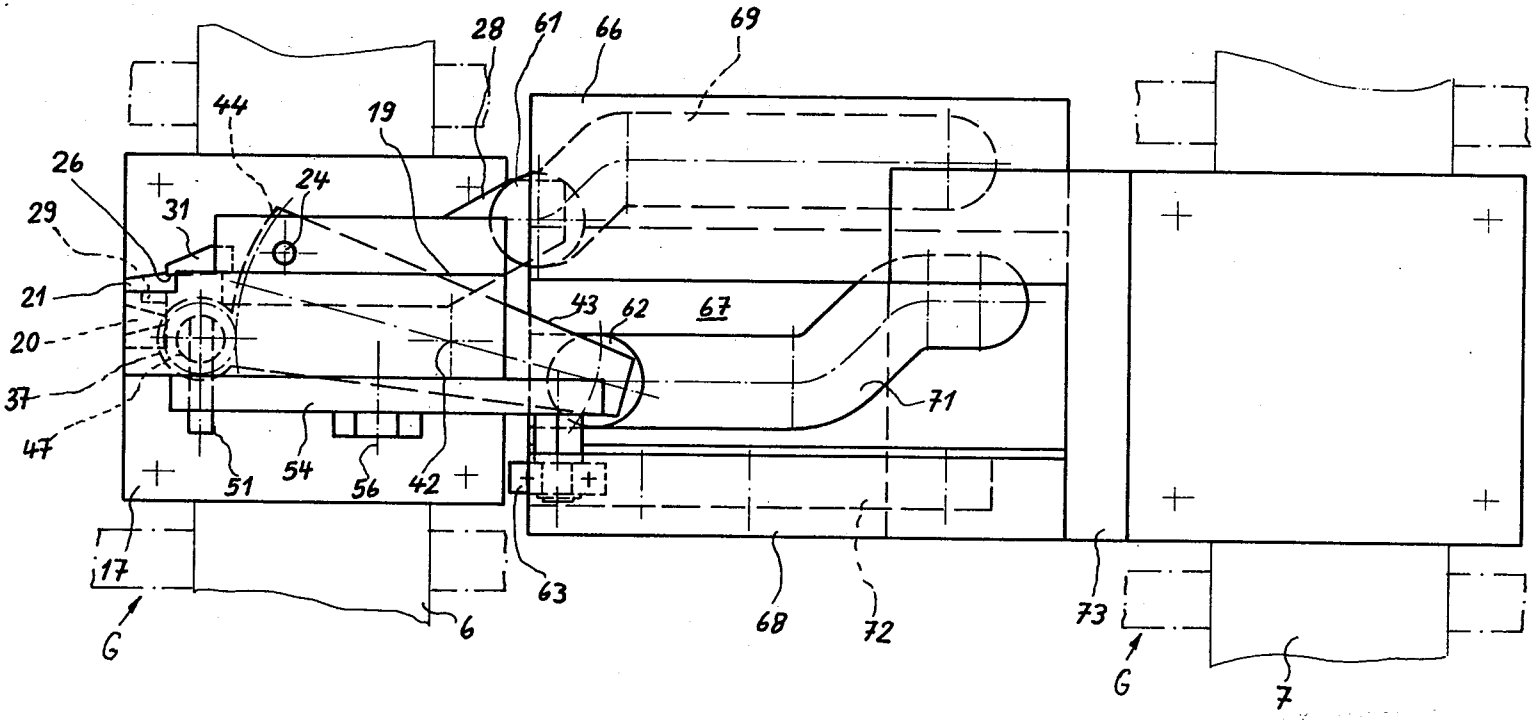
FIG. 2 is a plan view of the apparatus.
Figure 3:
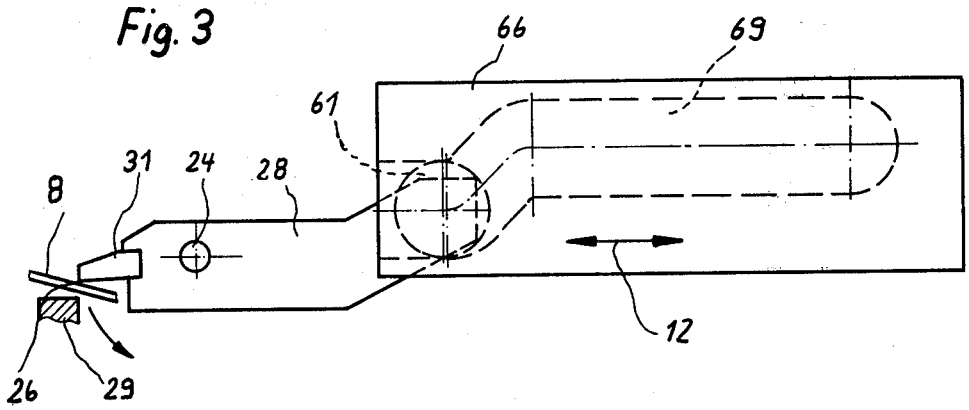
FIG. 3 is an enlarged plan view of the wire clipping and bending tool in the apparatus of FIGS. 1 and 2.
Figure 4:
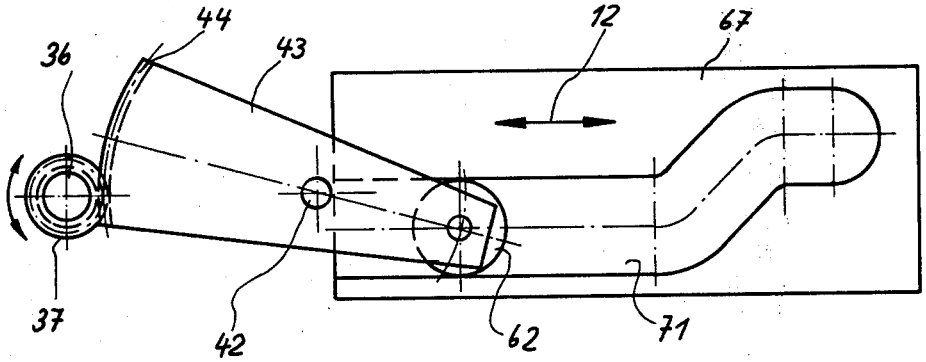
FIG. 4 is a plan view of actuating means for the loop forming device in the apparatus of FIGS. 1 and 2.

FIGS. 1 and 2 show the two main components of the improved apparatus, namely a severing or clipping and deforming or looping unit 1 and a driving unit 2. The units 1 and 2 respectively comprise plates 3 and 4 which are clamped (as by screws, bolts and analogous fasteners 5 denoted by phantom lines) to reciprocable carriers 6 and 7. The fasteners 5 allow for rapid and convenient changes in orientation of the unit 1 or 2 with respect to the corresponding carrier 6 or 7 and with respect to the helical binder 8 whose convolutions pass through the perforations or openings of the stack 9 of loose leaves. The manner in which the convolutions of the binder 8 are introduced into the openings of the stack 9 is disclosed, for example, in German Offenlegungschrift No. 2,234,633 to which reference may be had if necessary.

The carriers 6 and 7 are respectively movable in directions indicated by double-headed arrows 11 and 12. The guide means for the carriers is shown in FIG. 2, as at G; however, the means for reciprocating the carriers (such reciprocating means may include linkages and/or levers which receive motion from suitable cams) are not shown in the drawing. The carriers 6 and 7 are movable toward and away from the binder 8. The arrangement is such that the carrier 7 shares the movement of the carrier 6 toward the binder 8, that the carrier 7 thereupon moves toward the binder 8 independently of the carrier 6, that the carrier 7 thereupon moves away from the binder 8 independently of the carrier 6, and that the carriers 6 and 7 thereupon move in unison back to their starting positions.

The severing and looping unit 1 comprises a substantially U-shaped support 13, two plate-like distancing members 14 and 16 (see FIG. 5), a plate-like guide 17, a strip-shaped distancing member 18, and a bearing block 19 for the tools. The just enumerated components 13, 14 and 16 to 19 of the unit 1 are bolted, screwed or otherwise rigidly secured to each other. Furthermore, such components may be provided with pins or like projections which extend into the sockets or neighboring components to insure accurate positioning in assembled condition. The guide 17 is provided with a locating projection 21 which extends forwardly toward the binder 8 and has recesses 22 for the adjacent convolutions of the binder. The inclination of the recesses 22 matches the inclination of the convolutions of the binder 8. Each such recess can be formed by resorting to a milling tool which removes material from the locating projection 21. The surfaces bonding the recesses 22 support the corresponding convolutions of the binder 8 during looping of the free end portions of the end convolutions. For the convenience of manufacture, the recesses 22 are preferably slots which extend through the entire locating projection 21, and the extent to which the convolutions of the binder 8 can enter the corresponding recesses or slots 22 is determined by a plate-like stop 23 which is inserted into the projection 21. A V-shaped recess 20 in the bearing block 19 serves to receive a portion of the binder 8 and to thereby ensure that the binder is held in an optimum position during severing or clipping as well as during looping of portions of its end convolutions.

A combined clipping or severing and bending tool 28 is pivotably mounted on a pin or shaft 24 intermediate the guide 17 and bearing block 19. The tool 28 includes a lever which is provided with a knife or cutting edge 26 and a bending portion or edge 27. The axis of the pin 24 is normal to the axis 32 of the binder 8 (see FIG. 5). A counterknife 29 in the bearing block 19 cooperates with the knife 26 to sever or clip the end convolution **8*a* of the binder 8. In order to reduce wear upon the binder-engaging portions 26 and 27 of the tool 28, the latter preferably includes a hard metal plate or insert 31 one portion of which constitutes a cutting edge (of the knife 26) and another portion of which constitutes the edge 27 serving to bend the corresponding end convolution of the binder. The insert 31 can be replaced with a fresh insert when the portions 26 and 27** exhibit traces of pronounced wear.

Figure 5:
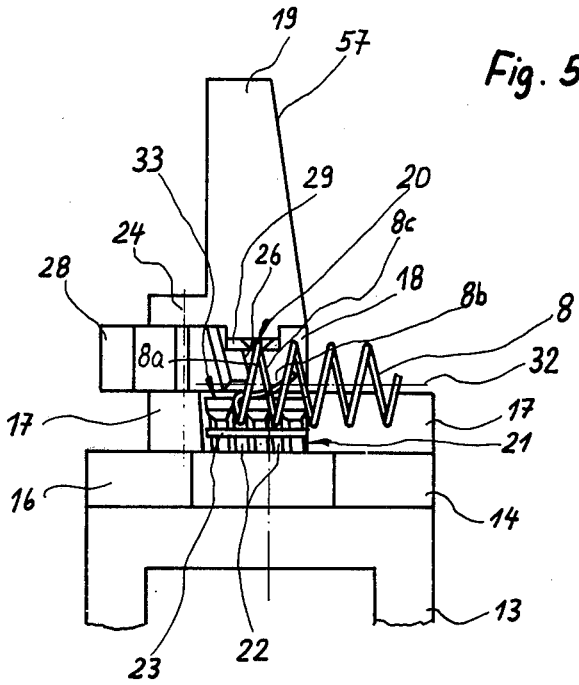
FIG. 5 illustrates a first stage of deformation of one end convolution of the binder.

The locating projection 21 of the guide 17 has a guide face 33 which is parallel to the axis 32 of the binder 8 (see particularly FIG. 5). The distance between the guide face 33 and the axis 32 equals or approximates the diameter of the wire which constitutes the binder 8. In the illustrated embodiment, the guide face 33 is located at a level below the axis 32.

Figure 8:
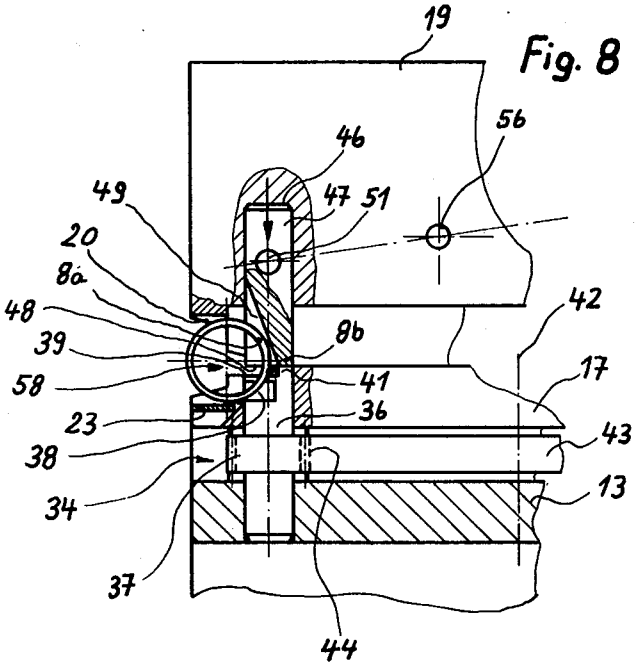
FIG. 8 shows a fourth stage.

A loop forming device 34 is rotatably mounted in the U-shaped support 13 and guide 17 (see particularly FIG. 8). The loop forming device 34 comprises a shaft 36 and a pinion or gear 37 on the shaft 36. The shaft 36 is formed with a cutout 38 which allows for turning of an eccentric looping edge 41 about the next-to-the-outermost convolution **8*c* of the binder 8. The edge 41 extends from a guide face 39 of the shaft 36. The guide face 39 of the shaft 36 is flush with the guide face 33 of the projection 21, and the bending edge 41 extends beyond the guide face 39 by a distance which equals or approximates the diameter of the wire constituting the binder 8**.

An actuating lever 43 which includes a gear 44 (preferably a segment) is pivotable on a pin 42 between the U-shaped support 13 and the guide 17. The gear 44 meshes with the gear 37 of the shaft 36. The pivot pin 42 for the actuating lever 43 is parallel to the pivot pin 24 for the tool 28, and these pivot pins are normal to the axis 32 of the binder 8.

Figure 7:
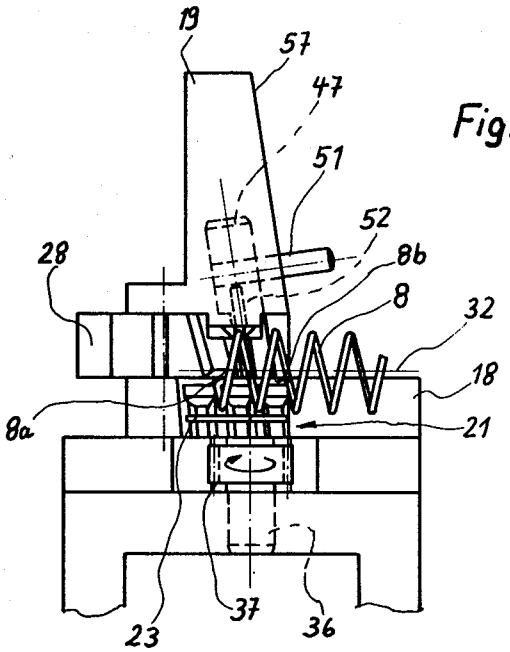
FIG. 7 shows a third stage.

The bearing block 19 has a bore 46 whose inclination to the vertical equals or approximates the inclination of convolutions of the helical binder 8 and which receives a hold-down device here shown as a round post or stud 47. The latter is reciprocable up and down in the bore 46. A guide face 48 (FIG. 8) of the post 47 is parallel to and located opposite the guide face 39 of the shaft 36. The post 47 is further formed with a notch 49 which guides the inner portion of the end convolution **8*a* and takes up bending stresses which are transmitted to the free end portion 8*b* of the binder 8 during the making of a loop. A pin-shaped guide element 51 is mounted in the post 47 at right angles to the latter's axis and extends into a slot 52 of the bearing block 19 as well as into a bifuracted portion 53 which forms part of a moving lever 54. Theslot 52 prevents rotation of the post 47 about its axis. The lever 54 is pivotable about the axis of a pin or shaft 56 which is mounted in the bearing block 19. A lateral surface 57 (FIG. 7) of the bearing block 19** is parallel to the axis of the post 47; the pin 56 is normal to the surface 57 and extends into a bore machined into such surface. The post 47 can enter the binder 8 between the convolutions 8*a* and 8*c*. The guide face 48 of the post 47 is parallel to the axis 32 of the binder 8. The inclination of the pin 56 with respect to the axis 32 equals or approximates the inclination of the axis 32 relative to the general planes of the convolutions 8*a*, 8*c*, etc. i.e., the inclination of the projection of the pitch helix into a plane including the axis 32.

In the operative position of the post 47, its guide face 48 defines a channel 58 with the guide face 39 of the shaft 36 and with the guide face 33 of the locating projection 21. When the tool 28 is moved to the foremost or operative position, a guide face 59 thereof is located opposite the guide face 33 of the projection 21 and such guide faces define an extension of the channel 58. The guide face 59 of the tool 28 begins at the bending edge 27 and is located opposite the guide face 33. The composite channel extends to the end portion 8*b* of the binder 8. The height of the channel 58 in the region of the end convolution 8*a* (while the post 47 moves toward the loop former 34) only slightly exceeds the diameter of the wire constituting the binder 8. The end portion 8*b* is immediately adjacent to the locus where the wire constituting the binder 8 has been clipped by the tool 28 in cooperation with the counterknife 29 of the bearing block 29.

The tool 28 and the levers 43, 54 respectively carry roller followers 61, 62 and 63 which extend into suitably configurated grooves 69, 71, 72 of cams 66, 67, 68 in the driving unit 2. The cams 66, 67 and 68 are mounted on a common supporting member 73 which is clamped to the carrier 7 by the aforementioned plate 4 and corresponding fasteners 5.

The operation:

It is assumed that the binder 8 has been introduced into the openings of the stack 9 and is at a standstill. In the next step, the aforementioned linkage or system of levers moves the carriers 6 and 7 toward the binder 8. The carrier 6 comes to a halt when the support 13 of the unit 1 engages an arresting member 10 (shown in FIG. 1). At such time, certain convolutions of the binder 8 enter the recesses 22 of the locating projection 21 and the recess 20 of the bearing block 19. This insures that the binder 8 is located in a predetermined position with respect to the unit 1.

Figure 6:
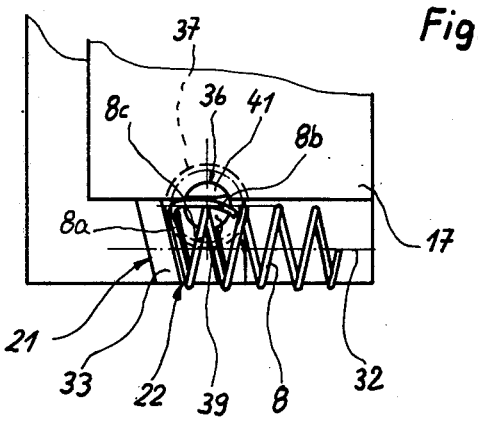
FIG. 6 shows the next stage.

The carrier 7 continues to move toward the binder 8 whereby the cam 66 causes the tool 28 to pivot about the axis of the pin 24 so that the knife 26 cooperates with the counterknife 29 to sever the binder before the free end portion 8*b* of the outermost convolution 8*a* undergoes deformation by the edge 27 in a manner as shown in FIGS. 5 and 6. Thus, the end portion 8*b* is bent over the next-to-the-outermost convolution 8*c*. As best seen in FIG. 6, the end portion 8*b* is not exactly parallel to the axis 32 of the binder 8 and to the guide face 33 of the projection 21 because its curvature equals or approximates that of the remaining (inner) portion of the convolution 8*a*.

The cam 68 thereupon causes the lever 54 to pivot about the axis of the pin 56 whereby the bifurcated portion 53 causes the pin 51 to move the post 47 in a direction toward the loop forming device 34. The guide face 48 of the post 47 urges the curved free end portion 8*b* of the binder 8 against the guide face 39 of the shaft 36 and against the guide face 33 of the locating projection 21, (i.e., the end portion 8*b* is caused to enter into and is confined in the aforementioned channel 59. The loop is formed in the channel 58 during the next stage of the cycle. During looping, the convolution 8*a* is held in one recess 22 of the projection 21 as well as in the notch 57 of the post 47 (see FIGS. 7 and 8), i.e., the notched portion of the post 47 engages the opposite sides of that portion of the convolution 8*a* which is inwardly adjacent to the end portion 8*b*.

Figure 9:
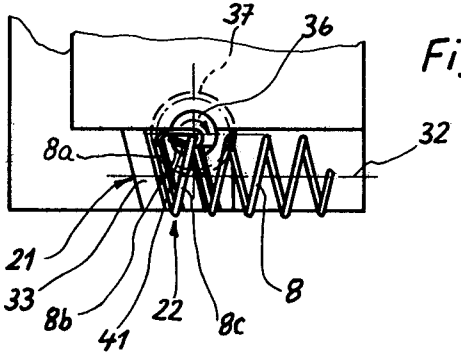
FIG. 9 shows the last stage which results in the formation of a loop surrounding the next-to-the-outermost convolution of the binder and being disposed in a plane including the axis of the binder.

The cam 67 thereupon causes the lever 43 to pivot about the pin 42. The gear 44 rotates the shaft 36 via gear 37 through an angle slightly exceeding 180 degrees. The edge 41 of the loop forming device 34 engages and moves the free end portion 8*b*, i.e., the end portion 8*b* is looped around the convolution 8*c* and is urged into the channel 58 (see FIG. 9).

The driving unit 2 is thereupon moved away from the binder 8 whereby the tool 28 and the levers 43, 54 reassume their starting positions in the just outlined sequence. The carriers 6 and 7 thereupon move in unison away from the binder 8 so that the stack 9 can be removed from the apparatus.

It goes without saying that the apparatus normally comprises two units 1 and two units 2 so that the free ends 8*b* of both end convolutions 8*a* can be looped at the same time.

Since the guide faces which define the channel 58 are parallel to the axis 32 of the binder 8, the loop (shown in FIG. 9) which surrounds the convolution 8*c* and whose free end is located radially inwardly of the convolutions 8*a*, 8*c* is disposed in a plane which includes the axis 32. The surfaces bounding the notch 49 of the post 47 hold that (inner) portion of the convolution 8*a* which is adjacent to the free end portion 8*b* so that the configuration (curvature) of such inner portion remains unchanged.

It has been found that the faces which define the channel 58 can guide the end portion 8*b* with a high degree of predictability if the distance between the looping edge 41 of the shaft 36 and the face 33 of the locating projection 21 equals or closely approximates the diameter of the wire constituting the binder 8, and if the distance between the guide face 48 (in the operative position of the post 47) and the edge 41 is less than the diameter of the wire. This insures that the end portion 8*b* cannot slide off the edge 41 while the gear 44 rotates the shaft 35. The end portion 8*b* exhibits a pronounced tendency to slide off the edge 41 because its curvature (prior to looping) equals or approximates that of the inner portion of the convolution 8*a*.

The feature that the recesses 22 of the locating projection 21 can receive portions of several convolutions (i.e., at least the convolutions 8*a* and 8*c*) insures that the convolution 8*c* is not deformed during looping of the end portion 8*b*. Therefore, the unit 1 can be readily withdrawn as soon as the looping of the end portion 8*b* is completed. As mentioned above, that portion of the hold-down post 47 which is provided with the notch 49 straddles the inner portion of the convolution 8*a* so that the latter, too, cannot interfere with movement of the unit 1 away from the finished product when the looping of the end portion 8*b* is completed. The surfaces bounding the notch 49 form a substantially U-shaped composite retaining surface for the inner portion of the convolution 8*a*.

An important advantage of the improved apparatus is that the free end portion 8*b* of the binder 8 is positively guided during conversion into a loop. The formation of channel 58 insures that the wire of the binder 8 is urged against the edge 27 with a high degree of predictability. Moreover, the outermost convolution 8*a* is deformed only to the extent which is needed to form a loop, i.e, that (inner) portion of the convolution 8*a* which is located inwardly of the end portion 8*b* is not deformed at all because the inner portion is positively held from several sides in the notch 49 of the post 47.

Another important advantage of the improved apparatus is that the tool 28 and the levers 43, 54 receive motion from discrete cams of the driving unit 2. This, combined with the feature that the cams move as a unit, simplifies the construction and insures predictable movements of the tool and levers during each of any desired number of successive cycles. Moreover, the driving unit 2 is readily accessible independently of the unit 1 and vice versa. If desired, the pins for the tool 28 and levers 43, 54 can be provided with eccentric end portions so that the tool and each lever can be readily adjusted by the simple expedient of rotating its pin about the latter's axis.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for deforming at least one end convolution of a helical binder which is threaded through the openings of a stack of loose leaves or the like, comprising a locating device having means for holding at least one end convolution of a binder in a predetermined position; a tool having means for bending the free end portion of the end convolution over the neighboring convolution of the binder occupying said position; a hold-down device; means for moving said hold-down device between the end convolution and the neighboring convolution of the binder occupying said position; a loop forming device; and means for actuating said loop forming device so as to convert the bent end portion of the end convolution of the binder occupying said position into a loop which surrounds the neighboring convolution, said hold-down device having a first guide face and at least one of the other two devices having a second guide face which cooperates with said first guide face to define a channel confining the end portion of the end convolution during conversion into said loop.

2. Apparatus as defined in claim 1, wherein said bending means includes a portion of said tool which is arranged to bend the free end portion of the end convolution of the binder occupying said predetermined position to a position of substantial parallelism with the axis of the binder.

3. Apparatus as defined in claim 1, wherein said actuating means includes means for rotating said loop forming device, said loop forming device having an eccentric portion which converts the deformed end portion of the end convolution of the binder occupying said predetermined position into said loop in response to rotation of said loop forming device.

4. Apparatus as defined in claim 1, wherein the guide face of said hold-down device is substantially parallel to the axis of the binder occupying said predetermined position.

5. Apparatus as defined in claim 4, wherein said second guide face is substantially parallel to said first guide face.

6. Apparatus as defined in claim 5, wherein said second guide face is provided on said locating device and said loop forming device has a third guide face which is substantially parallel to said first and second guide faces, said actuating means including means for rotating said loop forming device and the latter including an eccentric portion extending from said third guide face and arranged to convert the end portion of the end convolution of the binder occupying said position into said loop in response to rotation of said loop forming device.

7. Apparatus as defined in claim 1, wherein said binder consists of wire having a predetermined diameter and said loop forming device has an eccentric portion, said actuating means including means for rotating said loop forming device to thereby convert the deformed end portion of the end convolution of the binder occupying said position into said loop by way of said eccentric portion in response to rotation of said loop forming device, said eccentric portion being spaced apart from said second guide face by a distance approximating said diameter, said moving means being operative to move said hold-down device with respect to said loop forming device between a first position in which said hold-down device extends between said end convolution and said neighboring convolution at a distance from said eccentric portion which is less than said diameter and a second position in which said hold-down device is withdrawn from the binder occupying said predetermined position.

8. Apparatus as defined in claim 1, wherein said hold-down device includes a portion which flanks the opposite sides of the end convolution of the binder occupying said predetermined position.

9. Apparatus as defined in claim 8, wherein said portion of said hold-down device has a notch which receives a portion of said end convolution.

10. Apparatus as defined in claim 1, wherein said means for moving said hold-down device includes a lever coupled to said hold-down device and pivotable about an axis whose inclination with respect to the axis of the binder occupying said position equals the inclination of the planes of said convolution with respect to said last mentioned axis.

11. Apparatus as defined in claim 1, wherein said tool includes a lever.

12. Apparatus as defined in claim 11, wherein said tool has an additional guide face which constitutes an extension of one of said first and second guide faces in that position of said tool in which said bending means thereof has completed the bending of said end portion.

13. Apparatus as defined in claim 12, wherein said additional guide face has an end portion adjacent to said bending means.

14. Apparatus as defined in claim 1, wherein said actuating mean includes means for rotating said loop forming device, said loop forming device including a first gear and said rotating means including a second gear mating with said first gear.

15. Apparatus as defined in claim 14, wherein said second gear is a segment and said rotating means further comprises a lever rigid with said segment and means for pivoting said lever about an axis which is normal to the axis of the binder occupying said predetermined position.

16. Apparatus as defined in claim 1, wherein said tool includes a pivotable lever and said actuating means includes a second pivotable lever having follower means and a mobile cam which is tracked by said follower means, said hold-down device being movable between and away from said convolutions and said means for moving said hold-down device including a third pivotable lever coupled to said hold-down device and having second follower means, and a second mobile cam tracked by said second follower means.

17. Apparatus as defined in claim 16, further comprisig common supporting means for said cams and means for moving said supporting means with respect to the binder occupying said predetermined position.

18. Apparatus as defined in claim 16, wherein said cams have grooves for the respective follower means.

* * * * *